US007811016B2

(12) United States Patent
Holzer et al.

(10) Patent No.: US 7,811,016 B2
(45) Date of Patent: Oct. 12, 2010

(54) FLATBED PRINTING MACHINE

(75) Inventors: Stefan Holzer, Emmendingen (DE); Markus Hilpert, Gundelfingen (DE); Konrad Vosteen, Bartenheim (FR)

(73) Assignee: Agfa Graphics NV, Mortsel (BE)

( * ) Notice: Subject to any disclaimer, the term of this patent is extended or adjusted under 35 U.S.C. 154(b) by 848 days.

(21) Appl. No.: 11/440,026

(22) Filed: May 25, 2006

(65) Prior Publication Data

US 2006/0280544 A1 Dec. 14, 2006

Related U.S. Application Data

(60) Provisional application No. 60/685,020, filed on May 27, 2005.

(30) Foreign Application Priority Data

May 25, 2005 (EP) ..... 05011314

(51) Int. Cl.
*B41J 13/24* (2006.01)
*B41J 13/00* (2006.01)

(52) U.S. Cl. ..... 400/622; 400/645; 101/423

(58) Field of Classification Search ..... 400/40, 400/48, 23, 656, 422; 347/104; 33/449; 211/69.1; 312/231; 101/126, 423, 425
See application file for complete search history.

(56) References Cited

U.S. PATENT DOCUMENTS 4,539,752 A * 9/1985 Beery et al. ..... 33/18.2
4,738,029 A * 4/1988 Held ..... 33/18.1
4,856,197 A * 8/1989 Auer et al. ..... 33/18.1
4,949,466 A * 8/1990 Auer et al. ..... 33/18.1
5,174,036 A * 12/1992 Lin ..... 33/449
5,582,104 A * 12/1996 Best et al. ..... 101/126
5,672,018 A 9/1997 Yamamoto et al.
5,676,238 A * 10/1997 Saastamo ..... 198/502.2
5,746,427 A * 5/1998 Hamid ..... 271/176
5,823,500 A * 10/1998 La Coste ..... 248/444
6,112,663 A * 9/2000 Ulrich et al. ..... 101/389.1
6,371,599 B1 * 4/2002 Hotomi et al. ..... 347/54
6,382,615 B1 * 5/2002 Ishiguro et al. ..... 270/58.12
6,609,791 B1 * 8/2003 Miyamoto et al. ..... 347/104
6,659,603 B2 * 12/2003 Kida et al. ..... 347/104
6,908,190 B2 * 6/2005 Iwatsuki et al. ..... 347/104
6,910,766 B2 * 6/2005 Haug ..... 347/104
6,986,616 B2 * 1/2006 Lee ..... 400/656

(Continued)

FOREIGN PATENT DOCUMENTS

DE 3509925 A1 * 10/1986

(Continued)

OTHER PUBLICATIONS

European Search Report dated Dec. 7, 2005.

*Primary Examiner*—Ren Yan
*Assistant Examiner*—David Banh
(74) *Attorney, Agent, or Firm*—Keating & Bennett, LLP

(57) ABSTRACT

A flatbed printing machine is provided with a printing table and a pressing device for a medium to be printed. The pressing device features parallel guide rails on both sides of the printing table, through which a pressing rail that is moveable above the printing table is guided. The pressing device is particularly applicable to a digital ink-jet flatbed printing machines.

5 Claims, 2 Drawing Sheets

U.S. PATENT DOCUMENTS

| | | | | |
|---|---|---|---|---|
| 7,175,354 | B2 * | 2/2007 | Niimi et al. | 400/48 |
| 2002/0089564 | A1 * | 7/2002 | Ohashi | 347/41 |
| 2003/0063941 | A1 * | 4/2003 | Shiraishi et al. | 400/718 |
| 2003/0077101 | A1 | 4/2003 | Feiner | |
| 2003/0179273 | A1 * | 9/2003 | Tsuji et al. | 347/104 |
| 2004/0066444 | A1 * | 4/2004 | Anami et al. | 347/104 |
| 2004/0165231 | A1 * | 8/2004 | Mitsuzawa | 358/498 |
| 2005/0139054 | A1 * | 6/2005 | Markowitz | 83/100 |
| 2005/0284278 | A1 * | 12/2005 | Shimizu et al. | 83/614 |
| 2006/0028525 | A1 * | 2/2006 | Sawai | 347/104 |
| 2006/0071385 | A1 * | 4/2006 | Berset et al. | 269/216 |
| 2006/0139432 | A1 * | 6/2006 | Takagi | 347/104 |
| 2008/0099982 | A1 * | 5/2008 | Yamanaka et al. | 271/157 |
| 2008/0198214 | A1 * | 8/2008 | Anami et al. | 347/104 |
| 2008/0273189 | A1 * | 11/2008 | Terada | 355/73 |

FOREIGN PATENT DOCUMENTS

| | | | | |
|---|---|---|---|---|
| JP | 02062299 | A | * | 3/1990 |
| JP | 04062198 | A | * | 2/1992 |
| JP | 04107192 | A | * | 4/1992 |
| JP | 05193220 | A | * | 8/1993 |
| JP | 05254200 | A | * | 10/1993 |
| JP | 05301401 | A | * | 11/1993 |
| JP | 08132786 | A | * | 5/1996 |

* cited by examiner

FLATBED PRINTING MACHINE

CROSS REFERENCE TO RELATED APPLICATIONS

This application claims the benefit of priority under 35 U.S.C. §119(e) to U.S. Provisional Application No. 60/685,020, filed May 27, 2005, and claims the benefit of priority under 35 U.S.C. §119(a) to European Application No. 05 011 314.1, filed May 25, 2005, the entire disclosures of these applications are herein expressly incorporated by reference.

This application is also related to U.S. application Ser. No. 11/440,029, entitled "Printing Table for Flatbed Printers" and U.S. application Ser. No. 11/440,025, entitled "Flatbed Printing Machine", filed on even date herewith.

BACKGROUND AND SUMMARY OF THE INVENTION

The invention refers to a flatbed printing machine with a printing table.

Particularly in the case of digital printing machines, high standards are imposed on the flatness of a printing table and on the medium to be printed. This is the case, for instance, because when using ink-jet heads, the heads must be held at a constant gap of about one millimeter above the medium to be printed. In conventional printing machines, vacuum holes are provided in the printing table in order to suck the medium to be printed against the surface of the printing table and thus prevent formation of creases on the medium to be printed.

With the invention, a flatbed printing machine shall be created which ensures that the medium to be printed lies on the printing table with its full-surface.

According to the invention a flatbed printing machine with a printing table and a pressing device for the medium to be printed is provided, wherein the pressing device exhibits parallel guide rails on both sides of the printing table, by which a movable pressing rail is guided along the printing table.

By providing such a pressing device, the medium to be printed can be pressed against the printing table, by use of the pressing rail and especially any air between the medium to be printed and the surface of the printing table can be swept out by the motion of the pressing rail above the printing table. Especially in connection with sucking the medium to be printed against the printing table surface, it can be ensured that the medium to be printed lies on the full surface on the printing table.

In a further embodiment of the invention the pressing rail is provided with a brush or a roller for pressing of the printing medium.

It is possible to smooth a medium to be printed both by using either a brush or a roller. The type of the medium to be printed, for instance, paper or film can be decisive for the choice of either a roller or a brush. In the case of a roller, it can roll passively and therefore a separate drive in not necessary.

In a further embodiment of the invention, the pressing rail may be lowered or raised by a lifting device on the printing table.

These measures allow the medium to be printed to be automatically smoothed and, furthermore, it can be ensured that when printing sheets of smaller size compared to the size of the printing table, it is not necessary to smoothen the entire surface. The lifting device features, for example, swiveling arms actuated by way of lift cylinders.

In a further embodiment of the invention, the printing table is provided with several vacuum holes leading to the printing table surface.

Such vacuum holes can, for instance, run perpendicular to the printing table and intersperse it. Suction applied to the vacuum holes can reliably hold the medium to be printed during the printing process. Any creases in the medium to be printed can then be smoothened by way of the pressing device according to the invention.

In a further embodiment of the invention, means are provided for applying suction to the vacuum holes, and may be controlled such that suction is then applied to a vacuum hole during the period when the pressing rail passes over the hole.

In this manner, smoothing of the medium is simplified, since the suction, for instance, is only applied when the pressing rail has passed over the respective vacuum hole. The result is that the medium to be printed is only sucked against the printing table surface when the respective area has already been traversed by the pressing rail, and thus already swept over and smoothened. In this manner, the process of smoothing out any creases in the medium to be printed, and at the same time sweeping out any air bubbles trapped between the medium to be printed and printing table surface, is not obstructed by adherence of the medium to be printed due to vacuum pressure. Since the motion of the pressing rail and the application of suction are adjusted to match one another, even in the case of comparatively low pressing pressure of the pressing rail, it is ensured that any creases on the medium to be printed are smoothened after the pressing rail has traversed above the medium to be printed.

In a further embodiment of the invention, the vacuum holes are arranged in rows on the printing table, parallel to the pressing rail, whereby a row of vacuum holes or a number of rows of vacuum holes assigned to this particular section are subjected to vacuum pressure.

Such a grid arrangement of vacuum holes simplifies their control. After the pressing rail has passed over a row of vacuum holes, suction remains active on this row in order to prevent the medium to be printed from shifting its position on the printing table during further movement of the pressing rail. Suction remains active also during the subsequent printing process.

Further features and advantages of the invention may be derived from both the claims and the following description of a preferred embodiment of the invention in connection with the drawings. The following are depicted in the drawings.

DETAILED DESCRIPTION OF THE DRAWINGS

Figure 1:
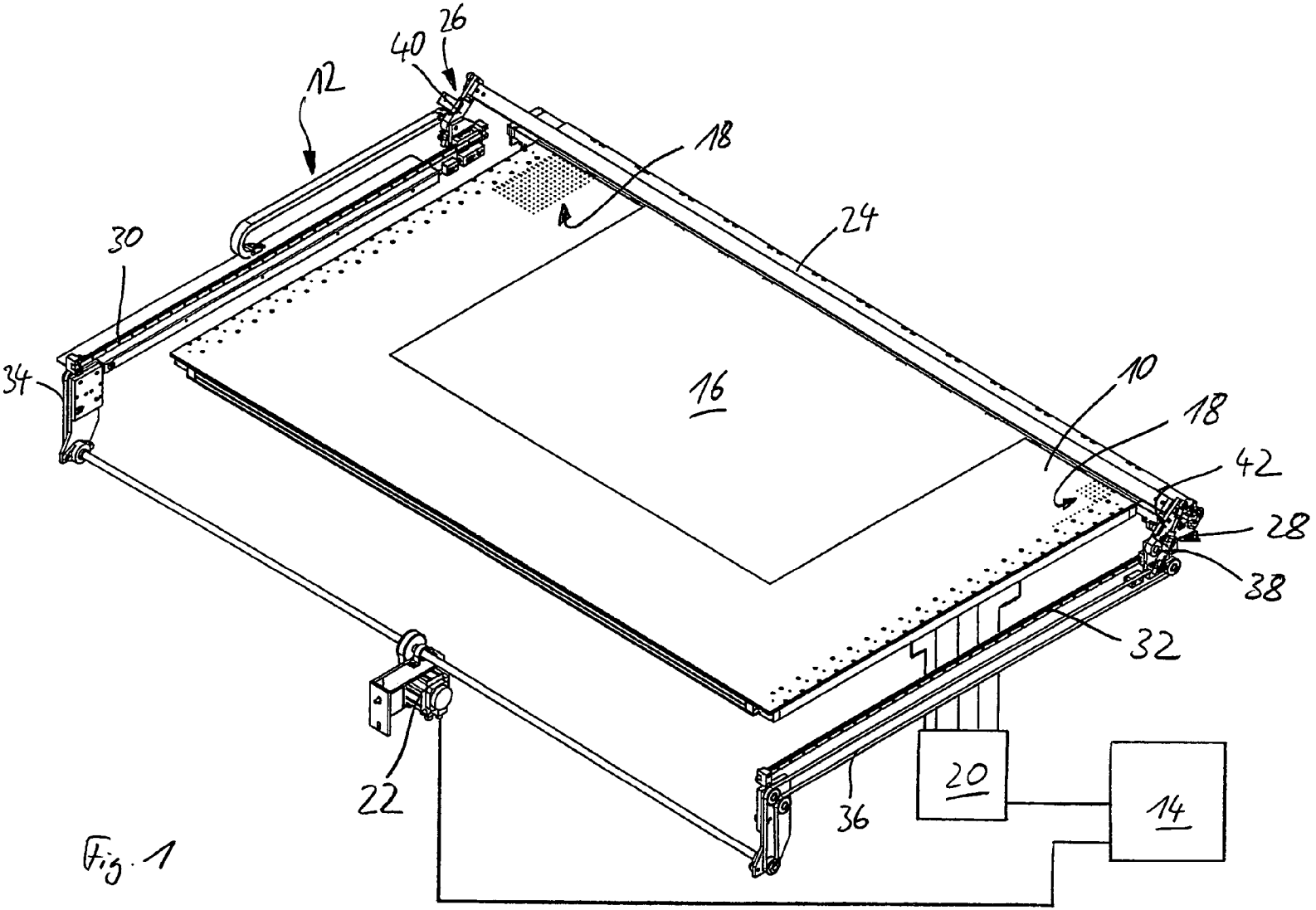
FIG. 1 is a partial illustration of a flatbed printing machine according to the invention with a printing table and a pressing device.

The illustration of FIG. 1 shows a partially illustrated flatbed printing machine in a perspective view. In the case of the flatbed printing machine, only a printing table 10 as well as a pressing device 12 and a control unit 14 are illustrated. On the printing table 10, a sheet of paper 16 is illustrated, which should be printed by use of the flatbed printing machine. The paper sheet 16 lies on the printing table 10 and is held on the table by means of suction. For this purpose, vacuum holes 18 are provided on the printing table surface and suction can be applied to these vacuum holes. After applying suction to the vacuum holes 18, the sheet of paper 16 will then be sucked against the surface of the printing table 10 and held on the surface, also during the printing process. Only a small portion of the vacuum holes 18 is depicted, whereas the vacuum holes are actually distributed over the entire printing table 10 with the exception of the right and left edge sections. The vacuum holes 18 are arranged in rows so that a grid type arrangement of the vacuum holes 18 is achieved. Suction to be applied to the vacuum holes 18 is generated by a pump and valve unit 20 that make it possible to apply suction to a selected row of vacuum holes 18. In the illustrated embodiment, the pump and valve unit 20 are depicted only schematically, and to indicate that individual rows of the vacuum holes 18 or sections comprising several combined rows thereof may be controlled separately, several connection lines from the printing table 10 to the pump and valve unit 20 are depicted schematically. The pump and valve unit 20 is controlled by the control unit 14, which is simultaneously in control of a servo drive 22 for the pressing unit 12.

The pressing unit 12 features a pressing rail 24, which stretches over the entire width of the printing table 10 and is connected with guide carriages 26, 28 on both ends. The guide carriage 26 runs on a guide rail 30 and the guide carriage 28 runs on a guide rail 32, wherein the guide rails 30, 32 are arranged parallel to the longitudinal sides of the printing table 10. By moving the guide carriages 26, 28 along the guide rails 30, 32, the pressing rail 24 can be traversed over the printing table 10. The guide carriages 26, 28 are driven by way of drive belts 34, 36, which are guided via idler pulleys mounted on the base (not depicted) of the flatbed printing machine. Both the drive belts 34, 36, and also both guide carriages 26, 28, are driven by way of a common shaft, which projects beyond the width of the printing table 10 and is driven by the servo motor 22.

The guide carriage 26, 28 furthermore exhibit a lifting device with pneumatic cylinders, wherein in the illustration of FIG. 1 only one pneumatic cylinder 38 is visible on the guide carriage 28. By means of the pneumatic cylinder 38 on the guide carriages 26, 28, the pressing rail 24 that is supported on the guide carriage 28 by way of an arm 40, 42 that may be swiveled, can be lowered onto and lifted from the printing table 10. In the illustration of FIG. 1, the lifted state of the pressing rail 24 is depicted. The pneumatic cylinder 38 is also operated via the control unit 14.

Figure 2:
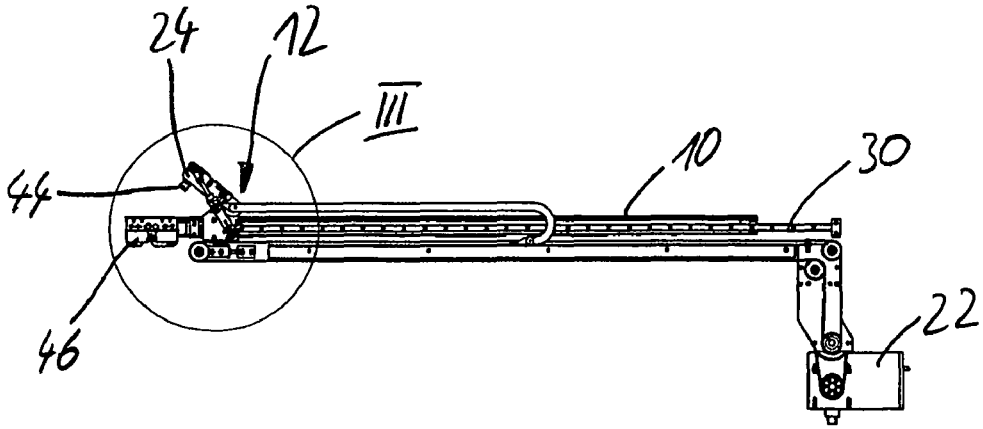
FIG. 2 is a side view of the flatbed printing machine of FIG. 1.

In the side view of FIG. 2, apart from the pressing device 12 with pressing rail 24 and the printing table 10, it can further be seen that the pressing rail 24 is provided with a brush 44 that lies on the sheet of paper 16 in the lowered state of the pressing rail 24 during a motion of the pressing rail 24 along the guide rails 30, 32, and thus smoothens the sheet of paper. Also in FIG. 2, the lifted state of the pressing rail 24 from the printing table is illustrated.

In FIG. 2, a gripper unit 46 that grips the front edge of the sheet of paper 16 and brings it into its intended printing position is also visible. For this purpose, the gripper unit 46 can be traversed along guide rails (not depicted) in the longitudinal direction of the flatbed printing machine. For instance, the printing table 10 can be lowered while a sheet of paper is transported by the gripper unit 46, and moves back to its lifted position as illustrated in FIG. 1 and FIG. 2 for the next pressing process and following printing process.

Figure 3:
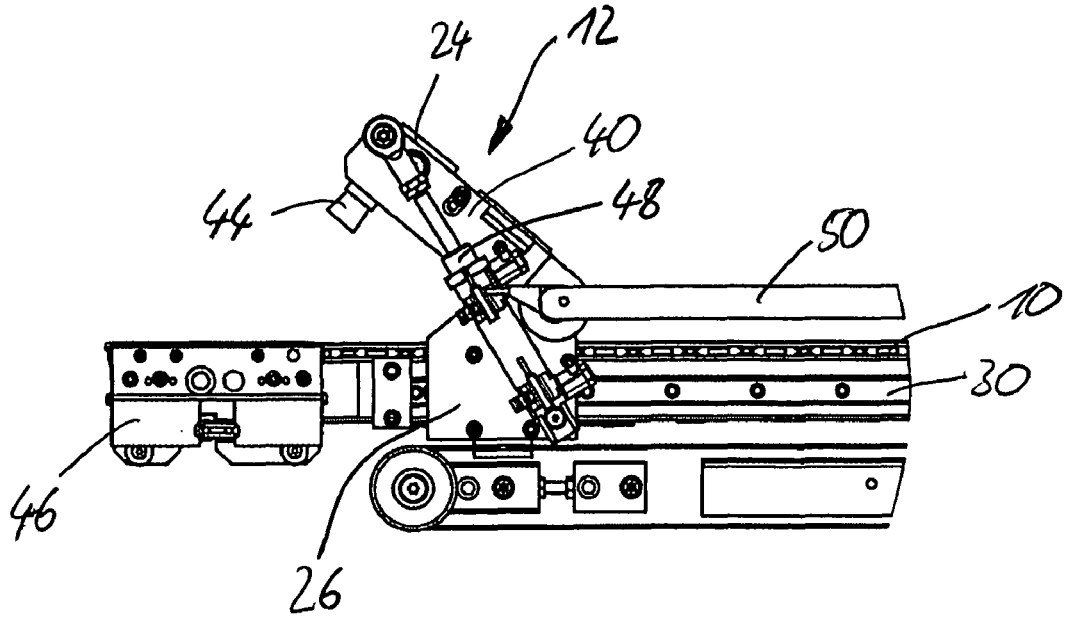
FIG. 3 is an enlarged illustration of the detail III of FIG. 2.

In the enlarged illustration of the detail III in FIG. 3, the pressing device 12 can be seen dearly. The pressing rail 24 is fixed on both of its ends on the swivel arms 38, 40, wherein, in the illustration of FIG. 3, only swivel arm 40 is visible. The swivel arms 38, 40 are respectively pivoted on a corresponding guide carriage 26, or 28. The guide carriages 26, 28, as already described by means of FIG. 1, can be traversed again on the guide rails 30 or 32 along the printing table 10. The swivel arms 40, 42 can be traversed by way of a corresponding pneumatic cylinder 38, from the lifted position as illustrated in FIG. 3 to a lowered position, wherein, in the lowered position, the brush 44 lies on the printing table surface of the printing table 10. In the illustration of FIG. 3, only a pneumatic cylinder 48 is visible, which is pivoted on the one hand on the swivel arm 40 and on the other hand pivoted on the guide carriage 26. The pneumatic cylinders 38, 48 are supplied with compressed air by way of a supply line 50.

After the sheet of paper 16 has been brought into its printing position on the printing table 10 by the gripper 46, the control unit 14 instructs that the pneumatic cylinders 38, 48 are operated such that the brush 44 on the pressing rail 24 is lowered onto the printing table surface and thus on the sheet of paper 16. After lowering the brush 44, the control unit 14 operates the servo-drive 22 such that the pressing rail 24 is traversed over the printing table 10. Thereby, the brush 44 sweeps over the sheet of paper 16 making it smooth, so that the latter lies on the full surface on the printing table. During the motion of the pressing rail 24 over the printing table 10, the control unit 14 operates the pump and valve unit 20 such that suction is applied to the vacuum holes 18 only then, when the brush 44 is within the section of a respective row of vacuum holes or a section comprising several rows of vacuum holes. The control unit 14 particularly operates the vacuum holes 18 in rows, by means of the pump and valve unit 20, or according to predefined sections and suction will only be applied to a respective row of vacuum holes when the brush 44 has passed over the respective row of vacuum holes 18 or the respective section of vacuum holes 18 during its motion over the printing table 10. After the brush 44 has passed over a row of vacuum holes 18 or over a defined section, suction remains applied to these vacuum holes 18. Suction will therefore be applied to these vacuum holes 18 according to the progressive motion of the pressing rail 24.

This results in that the sheet of paper 16 can be made easily smoothened by use of the brush 44, since it is not sucked onto the printing table surface 10 in the section to still be smoothened, and not yet swept over by the brush 44. Vice versa, the sheet of paper 16 in the section already swept over by the brush 44 will be held securely and completely on the surface on the printing table 10, since suction is already applied to the vacuum holes in the section that the brush has swept over.

With the device according to the invention, it is possible to achieve a particularly good, full-surfaced contact between the sheet of paper 16 and the printing table surface 10. This is very important for digital flatbed printing machines, since, for instance, ink-jet heads of digital flatbed printing machines must be held at a constant gap of approximately one millimeter above the medium to be printed.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A flatbed printing machine with a printing table, the flatbed printing machine comprising:

a pressing device arranged to press a medium against the printing table, the pressing device including:

first and second guide rails arranged parallel or substantially parallel to and on both sides of the printing table;

first and second guide carriages arranged to run on the first and second guide rails, respectively;

a traversing device arranged to traverse the first and second guide carriages along the first and second guide rails;

a pressing rail pivotally connected to the first and second guide carriages, the pressing rail including one of a brush and a roller; and a lifting device arranged to lower and lift the pressing rail; wherein the one of a brush and a roller is arranged to press the medium against the printing table as the first and second guide carriages traverse the pressing rail across the printing table while the pressing rail is in a lowered position thereby sweeping the one of a brush and a roller across the medium to smooth out any creases in the medium and remove air bubbles from between the medium and the printing table;

the printing table includes a plurality of vacuum holes in a surface of the printing table;

a suction device is arranged to apply suction to the plurality of vacuum holes; and a control device is arranged to control the suction device such that suction is applied to a vacuum hole of the plurality of vacuum holes or to a section including more than one of the plurality of vacuum holes only after the pressing rail passes over the vacuum hole or the section including more than one of the plurality of vacuum holes.

2. The flatbed printing machine according to claim 1, wherein the traversing device includes a motor operatively connected to the first and second guide carriages.

3. The flatbed printing machine according to claim 1, wherein the traversing device includes first and second drive belts connected to the first and second guide carriages, respectively, a plurality of pulleys arranged to guide the first and second drive belts, and a motor arranged to drive the first and second drive belts.

4. The flatbed printing machine according to claim 1, wherein the lifting device includes at least one pneumatic cylinder operatively connected to the pressing rail.

5. The flatbed printing machine according to claim 1, wherein the plurality of vacuum holes are arranged in rows parallel or substantially parallel to the pressing rail on the printing table, and a respective row including more than one of the plurality of vacuum holes or a section including a plurality of combined rows is subjected to suction at one time.

* * * * *